US005961365A

United States Patent [19]

Lambert

[11] Patent Number: 5,961,365

[45] Date of Patent: Oct. 5, 1999

[54] CONNECTORS FOR A MODULAR BUILDING SET

[76] Inventor: Michael Lambert, 2201 Deschenes, Ottawa, Ontario, Canada, K2B 6N2

[21] Appl. No.: 08/828,032

[22] Filed: Mar. 27, 1997

[51] Int. Cl.[6] ..... A63H 33/06; E04C 2/38; F16D 1/00

[52] U.S. Cl. ..... 446/125; 446/109; 446/126; 446/128; 52/656.9; 403/170

[58] Field of Search ..... 446/80, 85, 109, 446/111, 122, 126, 125, 128, 388, 487, 488; 40/124.14, 124.15, 610, 539; 52/656.9; 403/169, 170, 171, 217

[56] References Cited

U.S. PATENT DOCUMENTS

| | | | |
|---|---|---|---|
| 1,100,061 | 6/1914 | Ebert | 446/109 |
| 1,347,808 | 7/1920 | Franklin | 446/126 |
| 2,765,580 | 10/1956 | Herrschaft | 446/126 |
| 3,767,237 | 10/1973 | Suchowski | 403/171 |
| 3,785,066 | 1/1974 | Tuitt | 35/72 |
| 4,142,321 | 3/1979 | Coppa | 446/85 |
| 4,171,590 | 10/1979 | Fischer | 446/122 |
| 4,319,418 | 3/1982 | Transport | 40/124.14 |
| 4,332,501 | 6/1982 | Slysh | 403/171 |
| 4,365,454 | 12/1982 | Davis | 446/126 |
| 5,000,717 | 3/1991 | Pfeiffer | 446/488 |
| 5,305,754 | 4/1994 | Honeywell et al. | 128/869 |
| 5,393,579 | 2/1995 | Witte | 446/488 |
| 5,632,390 | 5/1997 | Podergois | 211/195 |
| 5,842,318 | 12/1998 | Bass et al. | 52/653.1 |

FOREIGN PATENT DOCUMENTS

| | | | |
|---|---|---|---|
| 453699 | 12/1949 | Italy | 403/169 |

*Primary Examiner*—Robert A. Hafer
*Assistant Examiner*—Laura Fossum
*Attorney, Agent, or Firm*—Robert G. Hendry

[57] ABSTRACT

A toy construction kit which includes a structural element or connector having a centre panel and two or more rectangular side panels connected to the centre panel. The side panels are folded to form sleeve members of triangular cross section which are insertable in, and frictionally engaged in a hollow structural member of triangular cross section. The structural members and connectors are fabricated of corrugated cardboard so that the construction kit is safe light-weight and disposable.

3 Claims, 9 Drawing Sheets

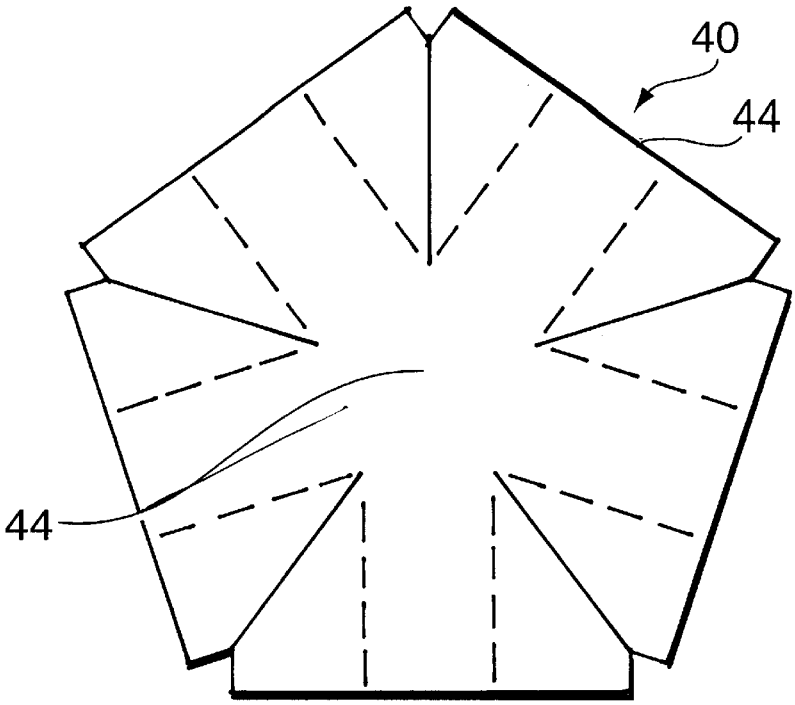
FIG. 6
FIG. 6A
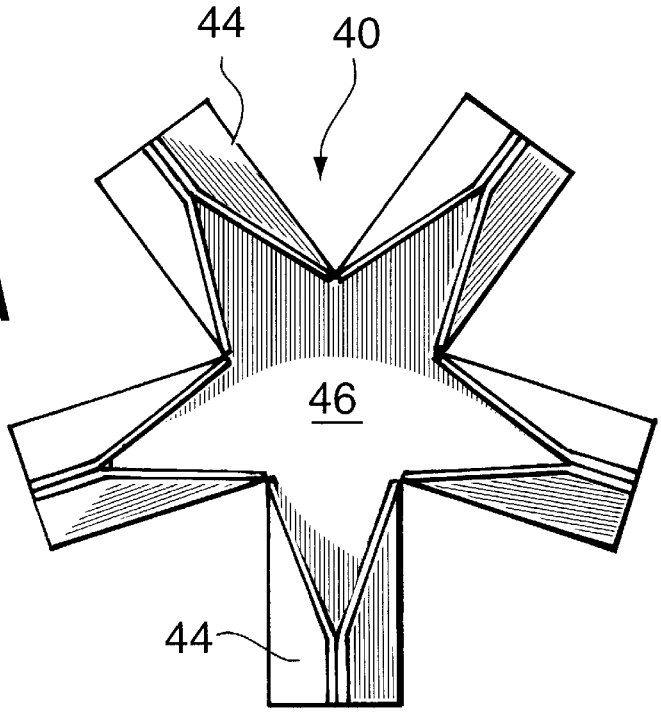

CONNECTORS FOR A MODULAR BUILDING SET

This invention relates generally to modular building components and more particularly to connectors used to join elements of structure such as domes, columns, and beams.

BACKGROUND OF THE INVENTION

There have been a number of building sets designed to be erected and dismantled by children. These include U.S. Pat. Nos. 3,803,754; 4,185,411; 4,571,200 and 4,527,981.

U.S. Pat. No. 4,185,411 is primarily concerned with a modular structure which will break away or come apart if too much weight is applied by a child. This toy does not provide the versatility required in an educational toy designed to encourage modelling of architectural structures. On the other hand, U.S. Pat. No. 4,527,981, while disclosing an apparatus for designing log structures, is restricted to small scale models of log cabins which may not provide the entertainment value of a larger play structure.

The present invention seeks to provide a creative, safe, lightweight, and versatile building set which can be expanded to provide play structures and enclosures large enough for grown children to walk around in.

The material used is preferably. corrugated box board, plain or waterproofed. This material is relatively inexpensive, particularly if recycled cartons are used. The structures are easily assembled through the use of the connectors which require very simple tools to fabricate.

The building set can be a teaching aid for older students. However, younger children can participate in the construction of the temporary play house. Components can be disassembled and stored for future use. The material used is easily disposed of and preferably recycled when necessary.

SUMMARY OF THE INVENTION

Accordingly the present invention seeks to provide a structural element of a toy construction kit comprising a connector including a center panel having at its side edges two or more rectangular sub panels each sub panel being divided into first, second and third panels by fold lines extending outwardly from the side edges of the center panel, one of the first, second or third panels being integrally joined to the center panel whereby the first second panels of each of the sub panels are folded to form a hollow member of triangular cross section dimensioned and arranged to frictionally engage in or receive a hollow strut of triangular cross section.

In the drawings, which illustrate preferred embodiments of the invention:

FIGS. 6 and 6A are top plan views before and after folding of a connector for use in constructing the structure of FIG. 5;

Figure 1:
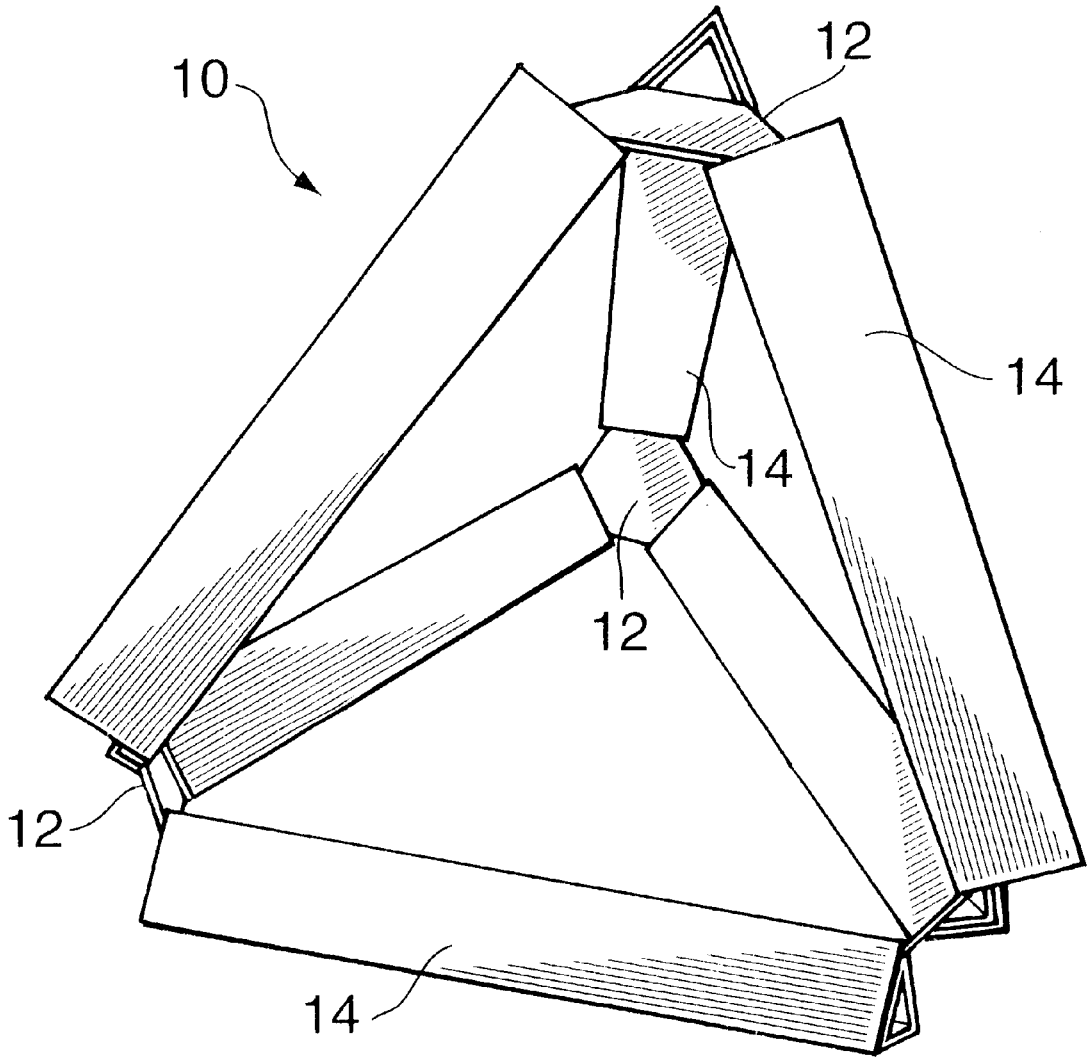
FIG. 1 is a perspective view of a dome structure constricted in accordance with this invention.

Referring now in detail to the drawings, a tetrahedron structure shown generally at 10 in FIG. 1 is one of the simple structures constructed in accordance with this invention, and might serve as an introduction to this method of construction for children or students.

The structure 10 includes three-way connectors 12 which connect the structural members or struts 14. Although the members 14 vary in length, there is no difference in construction and therefore only one member 14 will be described. Cardboard, preferably corrugated board, is folded along three longitudinal score lines and folded to provide a tube of triangular cross sections. The side seam is glued or taped as desired. An overlapping, or a tab and slot connection, could be used if desired but this is not considered to be essential.

Figure 2:
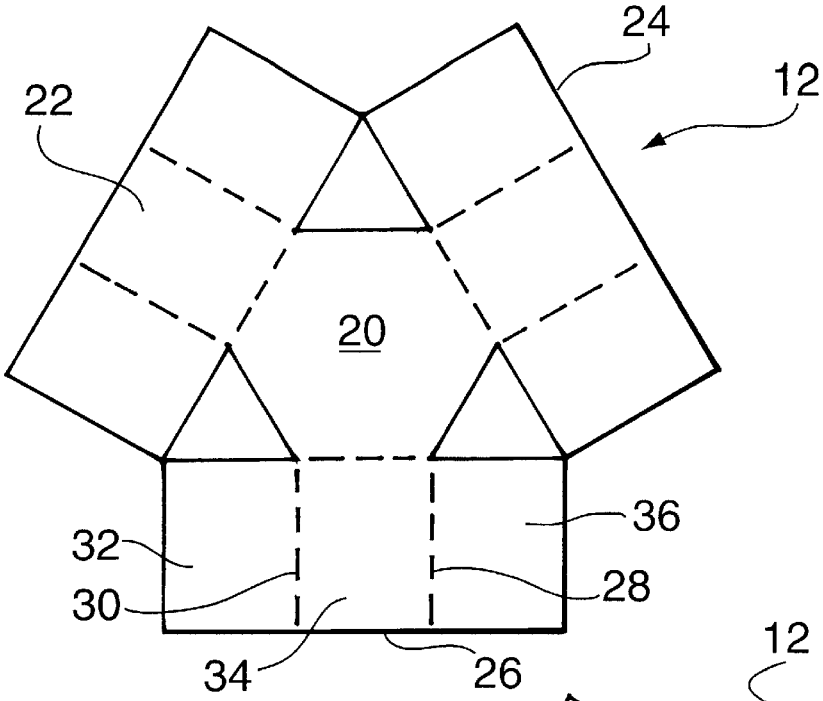
FIG. 2 is a plan view of one of the connectors prior to folding.
Figure 3:
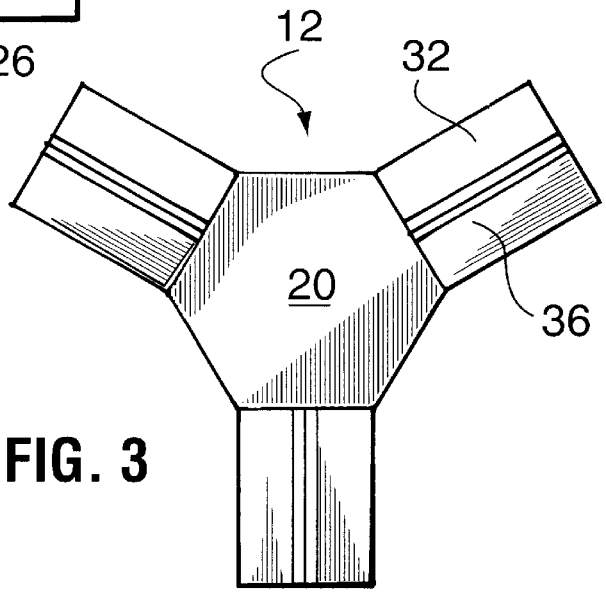
FIG. 3 is a top plan view of the connector of FIG. 1 after folding.
Figure 4:
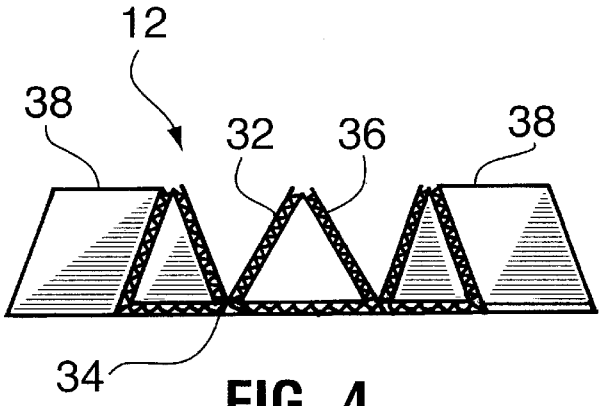
FIG. 4 is an end view of the connector of FIG. 3.

The structural element or connector 12 as shown in the flat or blank stage in FIG. 2 has a centre panel or hub 20 having three rectangular side panels 22, 24, 26 integral with the centre panel. Each of the rectangular panels 22, 24, 26 is divided by two score lines 28 and 30 to form three walls 32, 34 and 36 of the hollow member or sleeve 38 of triangular cross section as shown in FIGS. 3 and 4. The dimensions of the sleeve 38 are such that it is received in and frictionally engaged in the structural member 14.

It should be pointed out that once the basic principle of the connector is understood, a variety of forms of the connector can be created, and a variety of structures such as enclosures in the form of domes or other structures can be made up of posts and girders.

Figure 5:
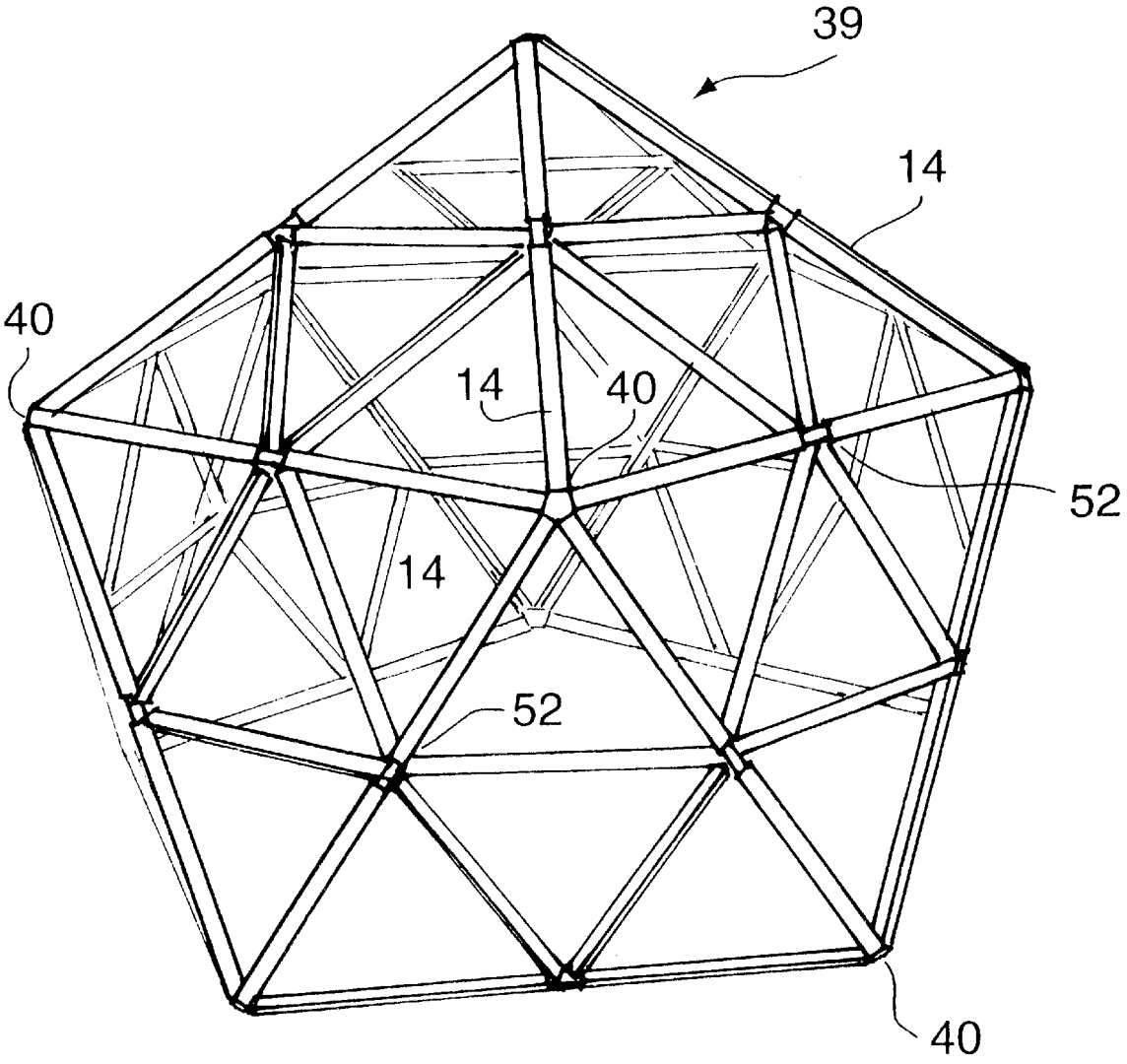
FIG. 5 is a perspective view of a dome structure employing alternative connectors.

A dome type enclosure shown at 39 in FIG. 5 is constructed of members 14 interconnected by connectors 40 shown in FIG. 6. Since the connector 40 is similar in most respects to the connector 12 described above, it will be understood that the connector 40 has two additional sleeve members 44 extending from a central panel or hub 46 so as to provide a five-way connector.

Figure 7:
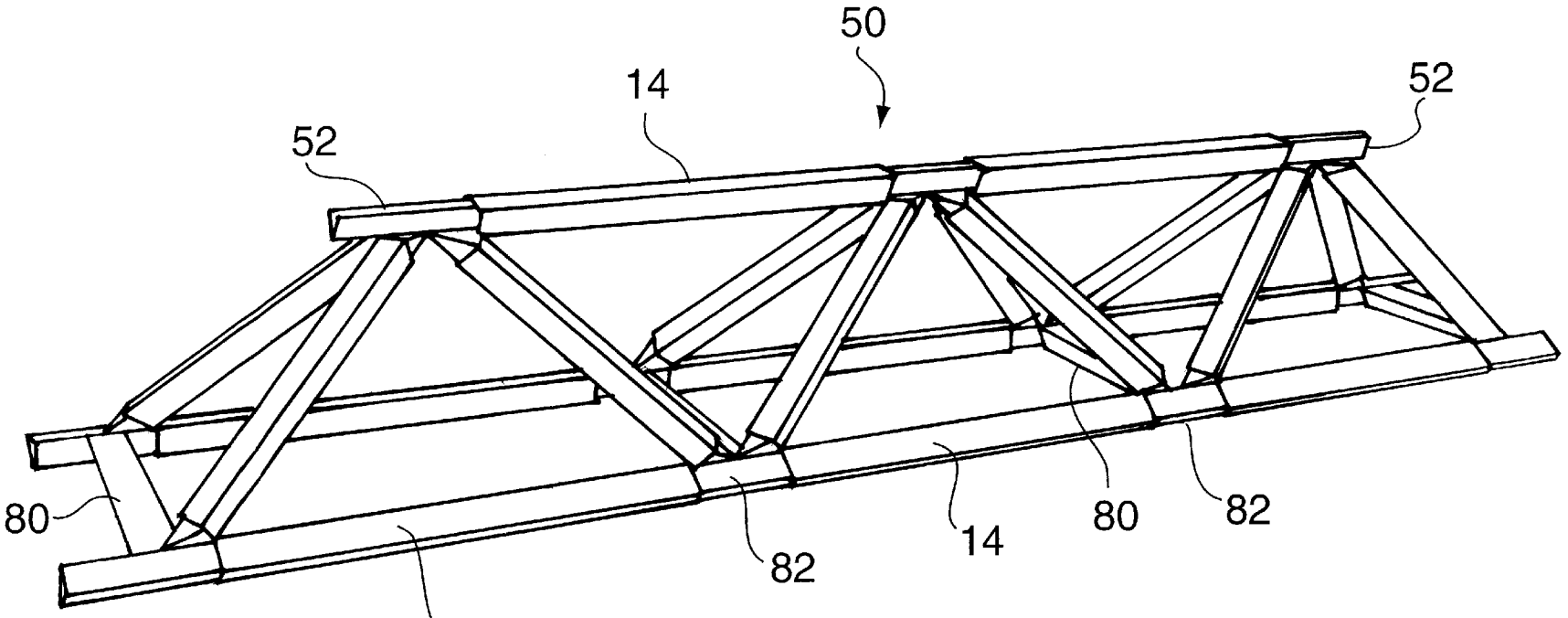
FIG. 7 is a perspective view of a girder type structure using the connectors of this invention.
Figure 8:
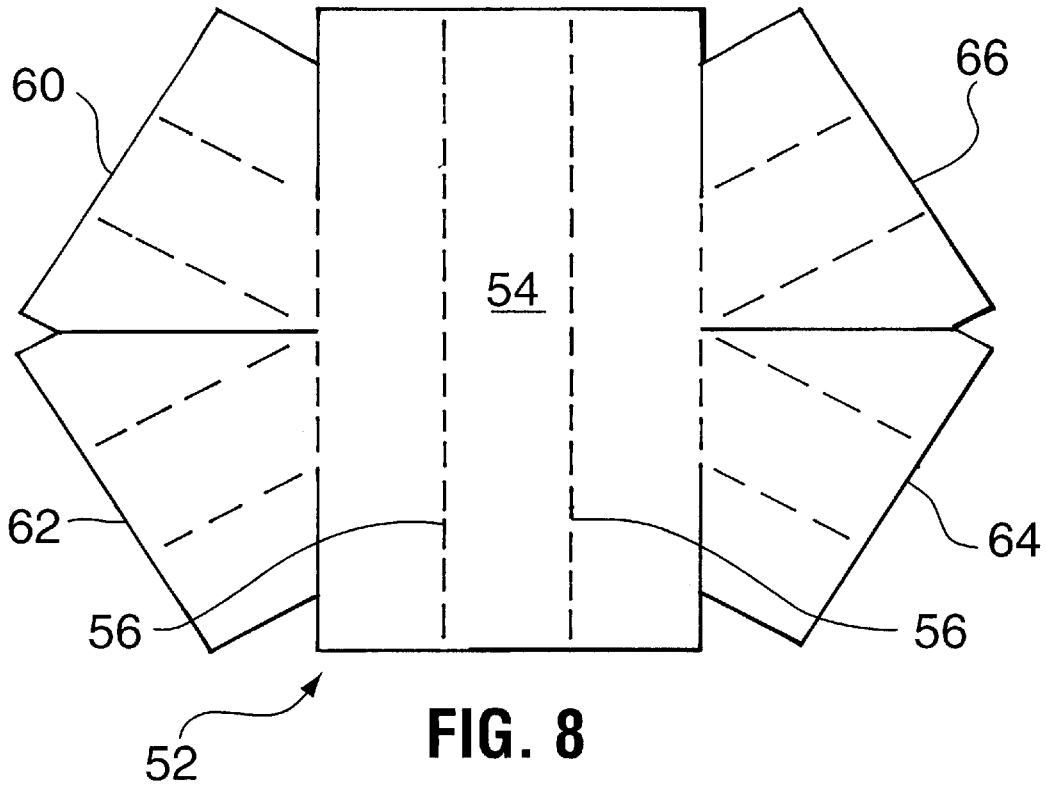
FIG. 8 is a top plan view of a connector used in the girder structure of FIG. 7 prior to folding.
Figure 9:
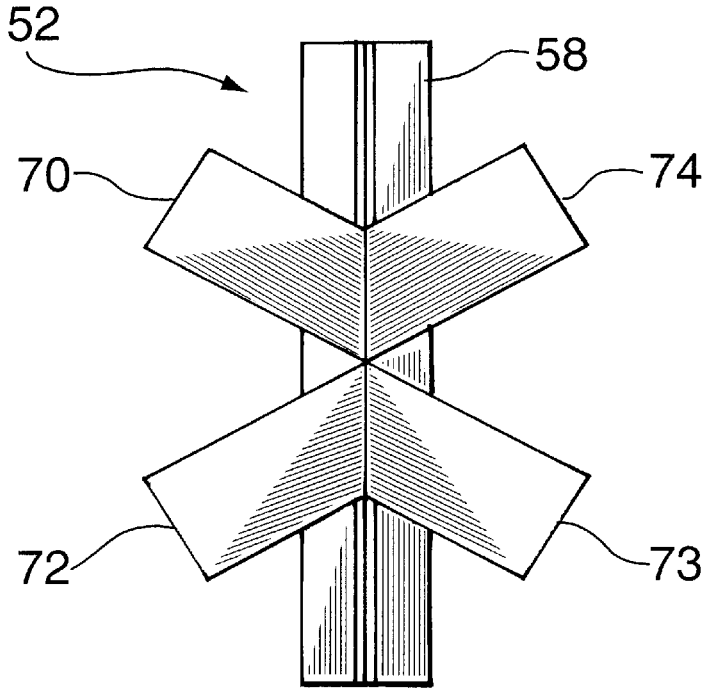
FIG. 9 is a top view of the connector of FIG. 8 after folding.

As shown in FIG. 7, a modified form of the connectors 12 and 40 facilitates the creation of girder type structures indicated generally at 50. Structural members 14 similar to those used in the dome of FIG. 5 are interconnected by fourway sleeve type connectors 52. The connector 52 differs from the connector 12 in that a centre panel 54 of the connector 52 is rectangular and is provided with score lines 56. The centre panel 54 is folded as shown in FIG. 9 to provide a sleeve 58 of triangular cross section.

Four panels 60, 62, 64 and 66 at the side edges of the centre panel 54 are also folded to form hollow triangular sleeve 70, 72, 74 and 78 angularly disposed to the sleeve 58.

Figure 10:
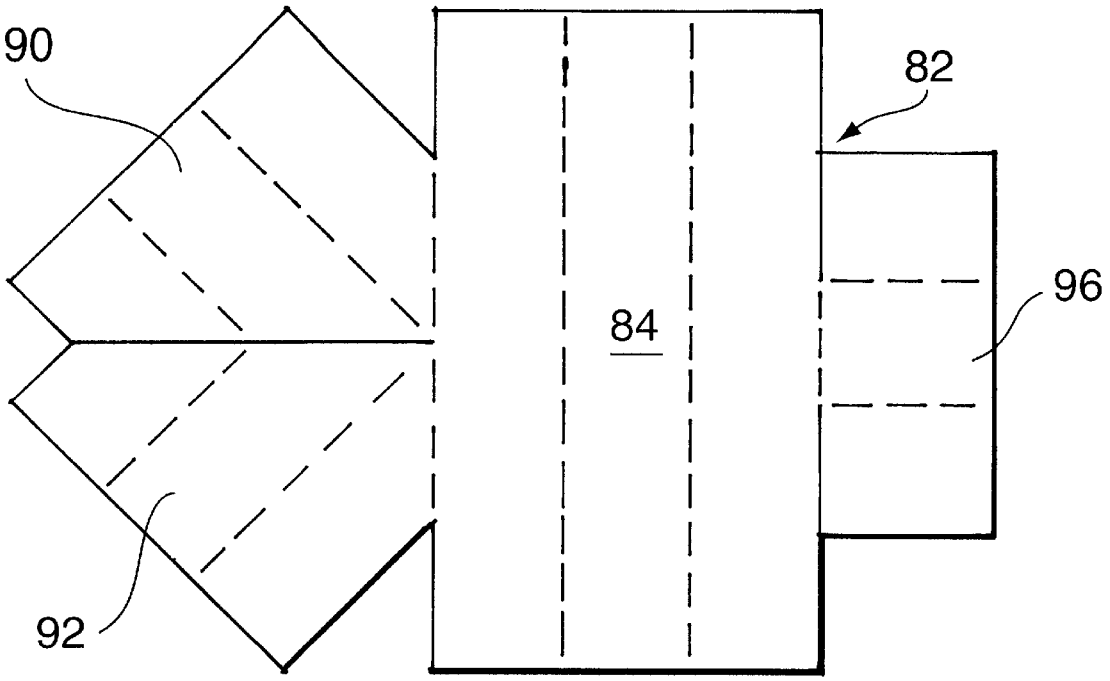
FIG. 10 is top plan view of another connector prior to folding.
Figure 11:
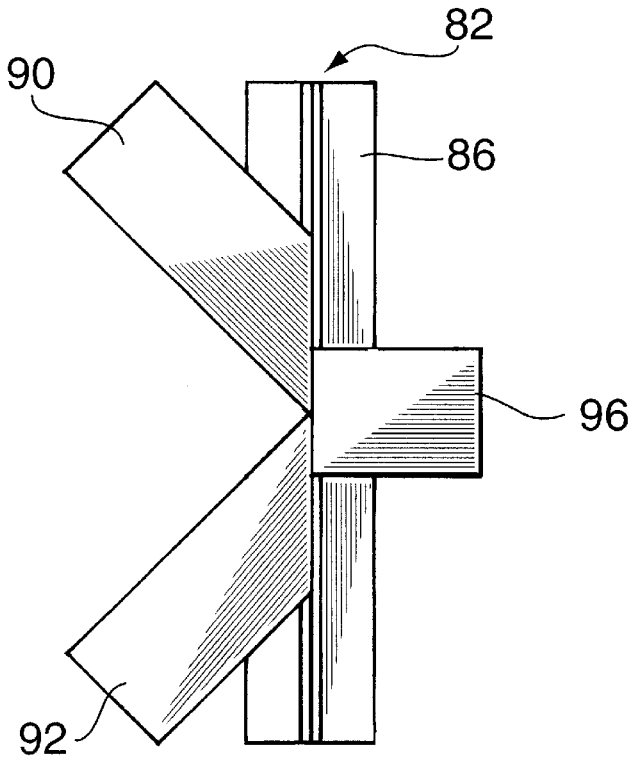
FIG. 11 is a top view of the connector of FIG. 10 after folding.

In order to provide the cross braces 80 of the girder 50, a connector 82 having a right angle sleeve is used. The connector 82 as shown in FIGS. 10 and 11 has a centre panel 84 which folds to form the sleeve 86, a pair of angled sleeve members 90 and 92, and a sleeve element 96 at right angles to the sleeve 86.

Figure 12:
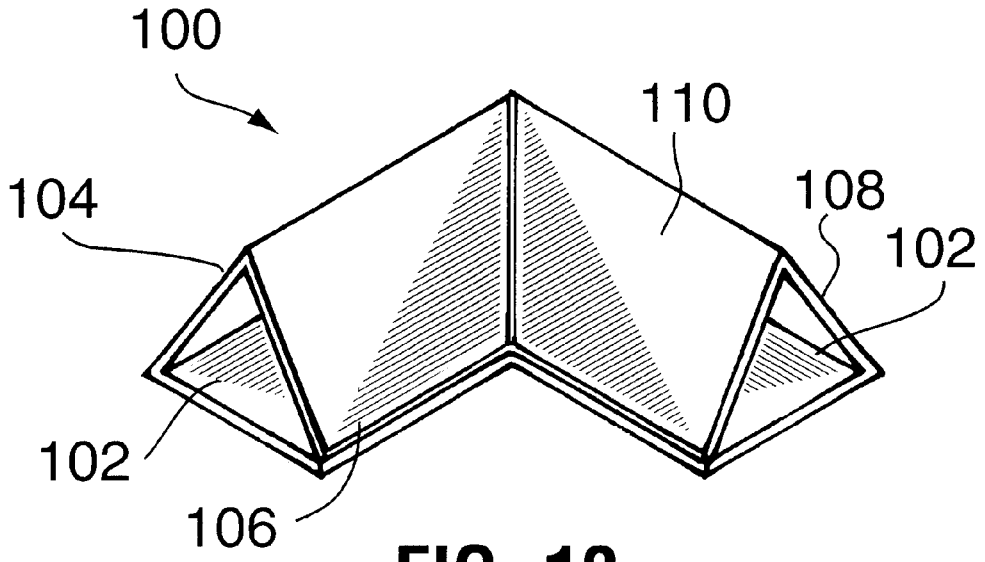
FIG. 12 is a perspective view of a sleeve for joining two structural members angularly disposed to each other.

A variety of sleeve type connectors can be used to create structures in accordance with this invention. The straight sleeve is merely a structural member 14 of reduced dimensions to fit inside the regular members 14. Other sleeve connectors include an elbow 100 shown in FIG. 12. The elbow connector has a base formed by two integral panels 102 disposed at right angles to each other. Panels 104 and 106 integral with the base 102 are folded to overly the panel 102 and provide the triangular cross section. Similarly, panels 108 and 110 are folded over to provide a triangular cross section at the other end of the connector 100.

Figure 13:
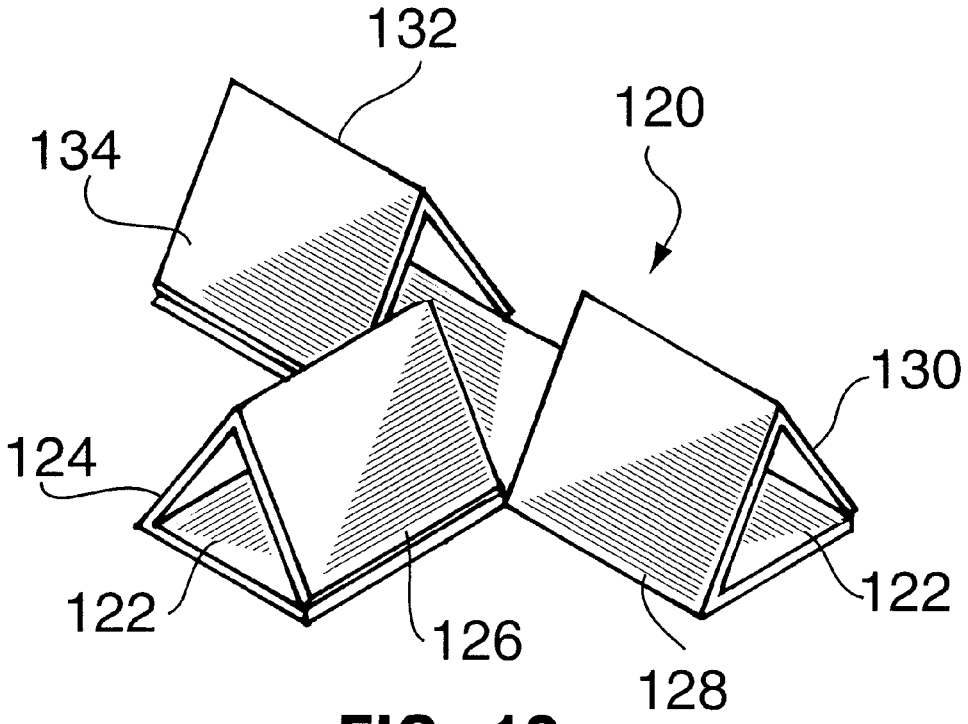
FIG. 13 is a perspective view of a T connector for use in dome or girder structures.

As shown in FIG. 13, a T connector 120 is formed by providing a T shaped base 122 having panels 124 and 126 joined to one side edge and folded to provide a sleeve of triangular cross section. Similarly, panels 128 and 130 provide a second sleeve of triangular cross section and panels 132 and 134 are folded to provide the same cross section.

Figure 14:
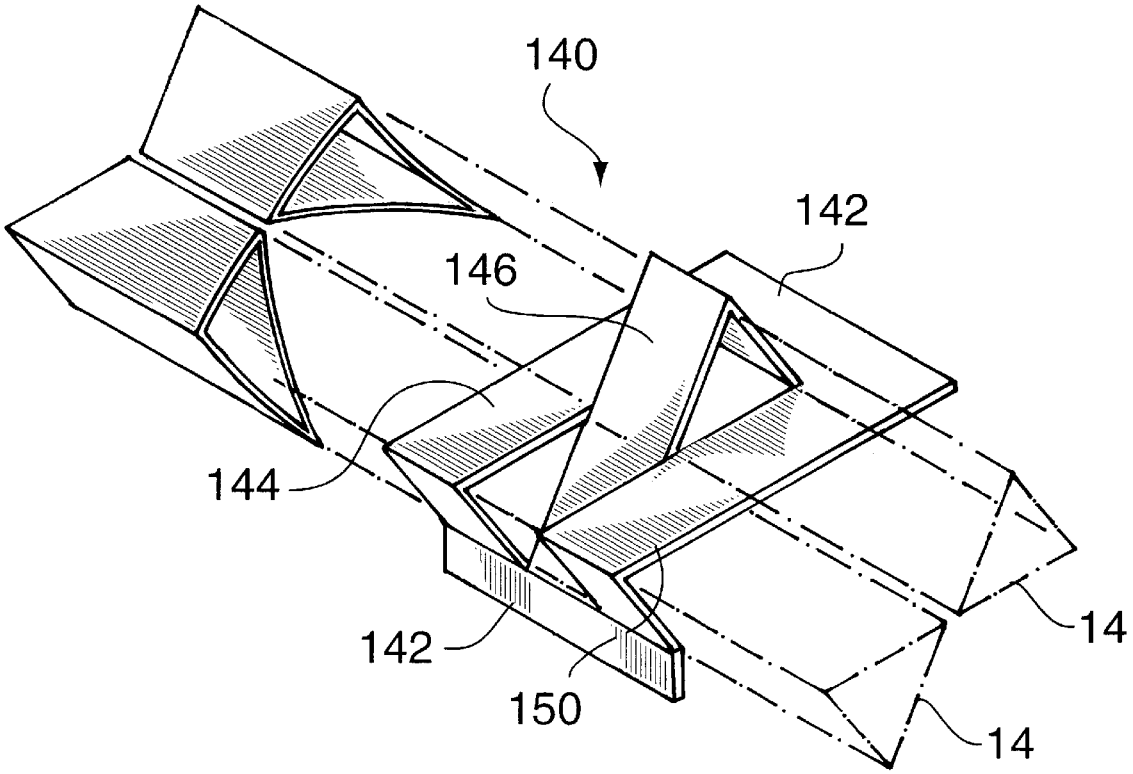
FIG. 14 is a hinge for use on the structural elements.

A hinge 140 is conveniently formed as shown in FIG. 14, by cutting slots in a rectangular cardboard panel 142 to form drips 144, 146 and 150 which pass over and under two adjacent structural members 14.

While the toy structural set and components thereof, shown and described in detail herein, are capable of attaining the objects stated above, it is understood that they are merely illustrative of the preferred embodiments of the invention. No limitations are intended in the details of the construction, design or materials shown other than defined in the appended claim.

The embodiments of the invention in which an exclusive property or privilege is claimed are defined as follows:

1. A structural element of a toy construction kit comprising a connector including a center panel having at its side edges three or more rectangular sub panels each sub panel being divided into first, second and third panel sections by fold lines extending outwardly from the side edges of the center panel, one of said first, second or third panel sections being integrally joined to the center panel whereby the first and second panel sections of each of the sub panels are folded so as to form a hollow member of triangular cross section frictionally enraging a hollow strut of triangular cross section.

2. A connector as claimed in claim 1 wherein the center panel includes a first center panel, a second center panel, and a third center panel divided by two longitudinally extending fold lines; said three or more rectangular sub panels are integrally joined to side edges of the center panel whereby the center panel is capable of being folded to form a hollow member of triangular cross section and the hollow members formed by the sub panels extend outwardly from the member formed by the center panel.

3. A connector as claimed in claim 1 wherein said three sub panels are arranged about the center panel to provide a T shaped arrangement of hollow members.

* * * * *